United States Patent [19]

Wilson

[11] 4,295,460

[45] Oct. 20, 1981

[54] COMBINATION HEAT TRANSFER PANEL AND WALL SHIELD FOR USE WITH STOVES AND OTHER RADIANT HEATERS

[75] Inventor: Thomas T. Wilson, San Carlos, Calif.

[73] Assignee: Epoxon Products, Inc., San Carlos, Calif.

[21] Appl. No.: 9,222

[22] Filed: Feb. 2, 1979

[51] Int. Cl.[3] ..... F24B 7/00

[52] U.S. Cl. ..... 126/121; 126/202; 432/65; 165/55; 237/52

[58] Field of Search ..... 126/120, 121, 428, 201, 126/429, 202, 431, 432, 439, 449, 450, 442, 6, 66, 67, 92 AC, 92 R, 92 B; 165/55; 237/52; 432/65

[56] References Cited

U.S. PATENT DOCUMENTS

| | | | |
|---|---|---|---|
| Re. 16,657 | 6/1927 | Andrews | 126/92 AC |
| 1,595,280 | 8/1926 | Zwisler | 126/92 AC |
| 2,595,905 | 5/1952 | Telkes | 126/428 |
| 2,743,720 | 5/1956 | Dollinger | 126/288 |
| 3,048,375 | 8/1962 | Walker | 126/432 |
| 3,891,445 | 9/1976 | Custer | 126/429 |
| 3,925,945 | 12/1975 | White | 126/429 |
| 3,960,135 | 6/1976 | Angilletta | 126/429 |
| 3,971,359 | 7/1976 | Bourne | 126/429 |
| 4,002,159 | 1/1977 | Angilletta | 126/429 |
| 4,008,705 | 2/1977 | Robertson | 126/121 |
| 4,014,313 | 3/1977 | Pedersen | 126/446 |
| 4,050,443 | 9/1977 | Peck et al. | 126/429 |
| 4,058,109 | 11/1977 | Gramm | 126/422 |
| 4,064,867 | 12/1977 | Schlesinger | 126/422 |

FOREIGN PATENT DOCUMENTS

| | | | |
|---|---|---|---|
| 1344299 | 10/1963 | France | 126/121 |
| 575121 | 2/1946 | United Kingdom | 126/92 AC |

*Primary Examiner*—James C. Yeung
*Attorney, Agent, or Firm*—Eugene D. Farley

[57] ABSTRACT

A combination heat transfer panel and wall shield for use with stoves and other radiant heaters. The device comprises a case housing two parallel, spaced curtains defining first and second convection chambers. The case is adapted for location either against, or in spaced relation to a structural wall behind a radiant heater. It is formed with a large central opening permitting entrance of radiant energy from the stove, a cold air inlet communicating with the convection chambers either at the lower end of the case or at the sides, and a hot air exhaust communicating with the upper end of the convection chambers. The outermost curtain may be constructed for adjustment between positions in which it absorbs or reflects radiant energy, as desired.

3 Claims, 5 Drawing Figures

COMBINATION HEAT TRANSFER PANEL AND WALL SHIELD FOR USE WITH STOVES AND OTHER RADIANT HEATERS

BACKGROUND AND GENERAL STATEMENT OF THE INVENTION

This invention pertains to a combination heat transfer panel and wall shield for use with stoves and other radiant heaters. Due to the limited nature of the supply of fossil fuels, it is apparent that these fuels should be reserved for areas in which they are uniquely useful and most critical. Residential and commercial space heating is not necessarily one of those areas; thus, we have witnessed in recent years interest in exploring alternative systems of harnessing energy for space heating, energy which can be derived economically from inexhaustible or replenishable sources. Such systems include nuclear reactors, geothermal and solar devices, windmills, ocean-wave-mills, etc.

Included in this category of alternative energy systems is the wood or coal burning heater/stove. Although wood is not an inexhaustible source of energy, it is replenishable. The revival of the traditional Franklin iron stove has been accompanied by the development of numerous refined embodiments of the traditional stove. New features include the principles of airtightness, thermostatic control, preheating of combustion air, etc. All such features tend to increase the efficiency of combustion so as to maximize the extraction of useful heat from a given amount of fuel.

Although the recent proliferation of iron and steel heater/stoves may well help to ease the burden on petroleum supplies, their installation in conventional wood-frame structures can present problems of safety and convenience. One fundamental problem is the fact that such radiant heaters must be installed with specific minimum clearances from combustibles, if they are to be installed safely. Such clearances can exceed three feet in some cases. This means that the floor space behind such a stove can be virtually useless to the home owner, floor space for which he has paid dearly.

Although radiant heaters are most effective when installed in the middle of a room, the vast majority of installations are not of this type; rather, for aesthetic or practical reasons, the heaters are placed as close as possible to walls or corners. One negative effect of this type of installation, from an efficiency point of view, is that a significant portion of the heat which is radiated from the rear of the stove is absorbed by the back wall and perhaps lost to the outdoors. Some manufacturers design their stoves with steel baffles attached to the rear of their units in order to minimize the amount of radiant heat produced there. Although reduced clearances can be achieved in this manner, it is clear that such a baffled unit produces less total heat than does an unbaffled stove and thus runs counter to the aim of extracting a maximum amount of heat from a given amount of fuel.

Prior art directed toward distance reduction for radiant heaters has for the most part been restricted to specified procedures of field masonry. For example, brick walls are constructed with carefully maintained air spaces behind them to insure a free flow of cool air along the back side. One drawback to this method is the cost involved—in some cases additional footings are required to carry the load of the additional masonry. In many instances such footings are not feasible.

Another method of distance reduction involves the use of prefabricated steel wall panels, hollow sheet metal pans filled with insulation. Whether or not this method of wall protection is truly effective, from a safety point of view, these panels do suffer from the standpoint of aesthetics.

Other methods include the use of various factory-made precast cement panels which are installed with spacers to insure the free flow of cool air on the back-side. In various ways, these panels all suffer from problems of weight, cost, inconvenience, and aesthetics.

It is a purpose of this invention to provide economical, convenient, aesthetically pleasing, and functional protective coverings for combustible walls, when these walls are exposed to sources of high radiant heat.

In addition to its function of protecting combustible surfaces, another primary function is to provide an effective means of utilizing heat energy from a radiant heat source and redirecting or converting it in such a manner that it proves most useful for the purpose of heating space.

Another important function of the device described herein is that of utilizing heat that normally is absorbed and lost by the walls located directly behind radiant heaters.

Still a further purpose of the invention is to provide a combination heat transfer panel and wall shield for use with stoves and other radiant heaters which is simple in construction, efficient in operation, low in cost, easily maintained, and attractive in appearance.

The hereindescribed apparatus accomplishing the foregoing and other objects of the present invention broadly comprises a case adapted for location either against, or in spaced relation to, a structural wall behind a stove or other radiant heater. The case comprises a base, a header and side panels.

The front of the case facing the heater has a central opening permitting the entrance of radiant heat. At its lower end preferably, or, alternatively, at the sides, it is provided with a cold air inlet or inlets. At its upper end it is provided with a hot air exhaust.

Curtains hang from the header and are arranged substantially parallel to each other in the plane of the case in spaced relation to each other as required to provide first and second convection chambers communicating with the cold air inlet and the hot air exhaust. The outermost curtain preferably is adjustable between a first position in which it absorbs the radiant heat, transferring it to the convection chambers, and a second position in which it reflects the radiant heat away from the interior of the case. Conduit means may be associated with the cold air inlet and the hot air exhaust for drawing cold air from, and circulating hot air to, selected space areas.

DESCRIPTION OF A SPECIFIC EMBODIMENT OF THE INVENTION

The hereindescribed combination heat transfer panel and wall shield is adapted for use with non-solar radiant heaters such as wood and coal burning stoves and fireplaces; oil, kerosene and alcohol burning heaters; and electric heaters. It is designed particularly for use with wood and coal burning stoves.

Figure 3:
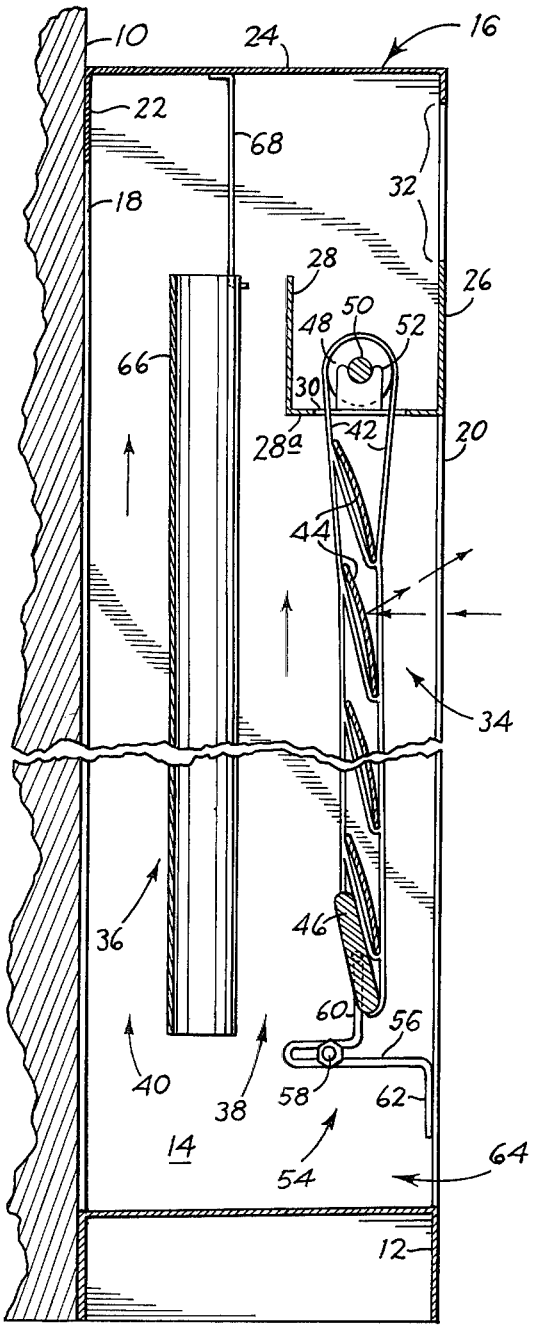
FIG. 3 is a foreshortened longitudinal sectional view taken along line 3—3 of FIG. 1.

As shown particularly in FIG. 3, the device is adapted for placement directly against a structural wall 10, which it shields, and behind a stove or other radiant heater, not illustrated, located nearby on the side opposite the wall.

The device is housed in a case comprising a base 12, a pair of upstanding side walls 14 and a header 16. These structural elements are fastened to each other by means of bolts, welding, or other suitable securing means.

The back of the case preferably has a large opening 18 to conserve material. The front of the case has a large central opening 20 which faces the radiant heater and admits radiant heat to the interior of the device.

In cross section, header 16 has the general contour of the letter G, arranged face down. It may be formed integrally from a single sheet of bent sheet metal. It comprises a short back wall segment 22, a top segment 24, a front wall segment 26, and a reversely bent inner segment 28, 28*a*. The floor 28*a* of the reversely bent inner segment is provided with opening 30 the purpose of which will appear later.

Front segment 26 is provided with a long opening 32. This serves as a hot air exhaust vent for the assembly.

The case above described houses two spaced curtain assemblies arranged parallel to each other in the plane of the case. The first curtain assembly, indicated generally at 34, is toward the front and serves the primary function of controlling the admission of radiant energy into the interior of the case. The second curtain assembly, indicated generally at 36, serves the primary purpose of providing a heat shield to protect wall 10.

Both curtain assemblies serve the further purpose of directing the flow of heat trapped and/or generated by the apparatus out hot air exhaust vent 32.

To this end the two curtain assemblies are spaced from each other and from the structural wall in such a manner as to provide a first, or outer, convection chamber 38 and a second, or inner, convection chamber 40. It will be observed that in the illustrated embodiment structural wall 10 itself provides one of the defining surfaces for inner convection chamber 40.

The first or outer curtain assembly 34 preferably comprises a plurality of vertically or horizontally arranged louvers which preferably are arcuate in contour and which preferably are components of the venetian blind sub-assembly illustrated in FIG. 3.

The construction of the venetian blind sub-assembly is substantially conventional. It comprises a plurality of vertical, ladder-shaped straps 42 made of fiberglass threads or other flexible, non-combustible material. The straps support a plurality of horizontally arranged louvers 44, and a base rail 46 in the usual manner. Straps 42 are supported on rollers 48 which in turn are fixed at spaced intervals to a shaft 50. The shaft in turn is supported rotatably on brackets 52 mounted on the floor 28*a* of the reversely bent terminal segment of the G-shaped header 16.

By pulling on straps 42, or on a conventional pull chord, not illustrated, the louvers 44 may be shifted between a first position in which one of their faces is toward the front, a second position in which the other of their faces is toward the front, or to any intermediate position. This makes possible adjusting the curtain so that it either absorbs the radiant energy entering through opening 20 or reflects it back to the exterior.

This is accomplished by painting one side of the louvers 44 with a white, metallic, or other radiant-energy-reflecting coating and painting the other side of the louvers with a black, or other dark colored radiant-energy-absorbing coating. Thus, for example, when the louvers are in their FIG. 3 position, with their light colored convex surfaces facing outwardly, they present a barrier which reflects radiant energy back into the space in which it is generated. However, when the louvers are in their FIG. 5 position, the radiant energy is absorbed by the louvers and is transmitted to the interior of the case.

Figure 1:
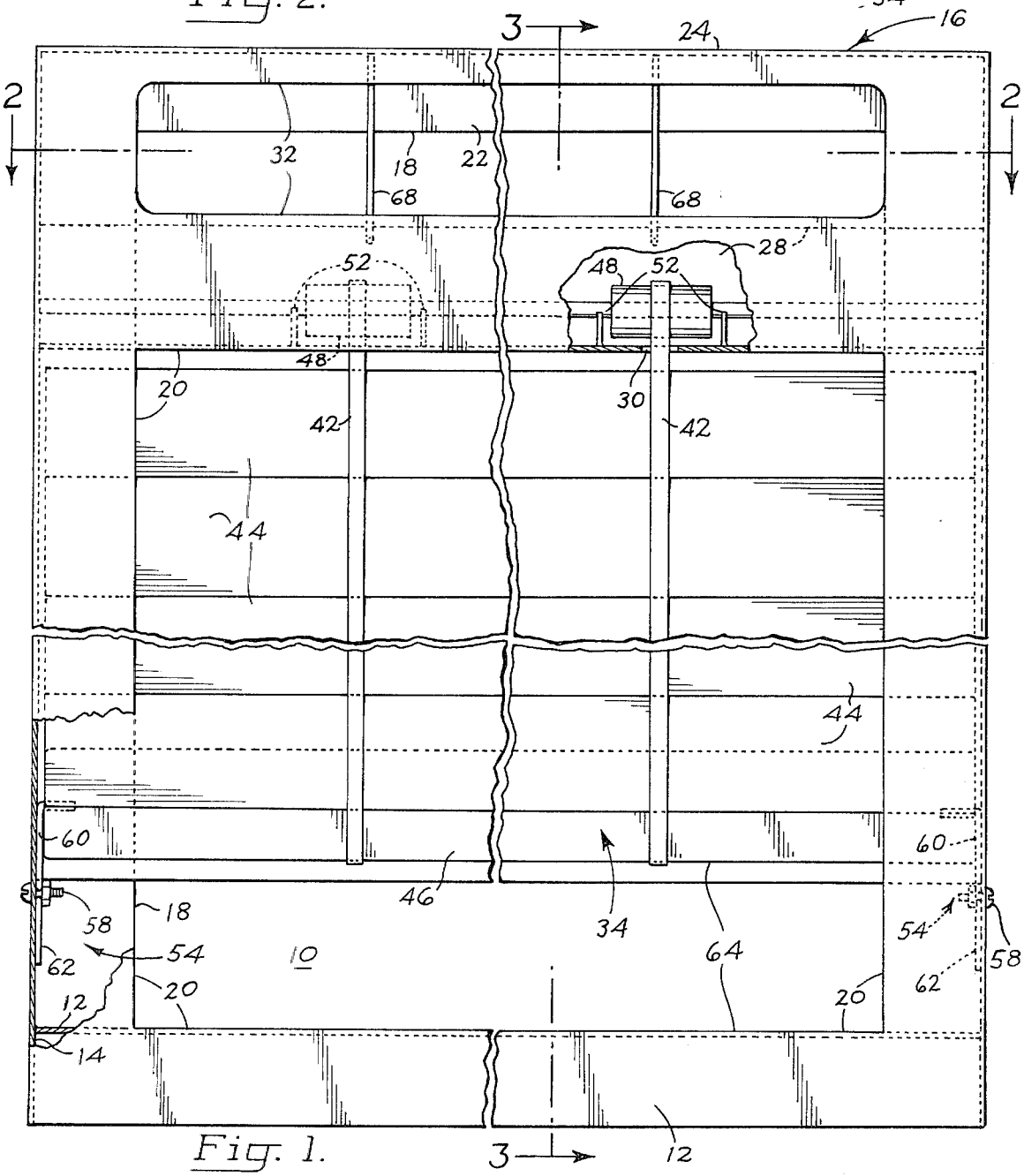
FIG. 1 is a foreshortened vertical elevation of the combination heat transfer panel and wall shield of my invention, with parts broken away to show interior construction.

The venetian blind assembly may be positioned and spaced by means of the wire clip spacers illustrated particularly in FIGS. 1 and 3.

The spacers are indicated generally at 54. They include a central, reversely bent central segment 56 which is secured to the adjacent side wall 14 by means of bolts 58.

A bent anchoring segment 60 penetrates the adjacent end of rail 46. The opposite terminal portion 62 extends downwardly and abuts against the inner front of the case, thereby insuring a properly spaced relation between the outer curtain assembly 34 and the inner curtain assembly 40.

Figure 2:
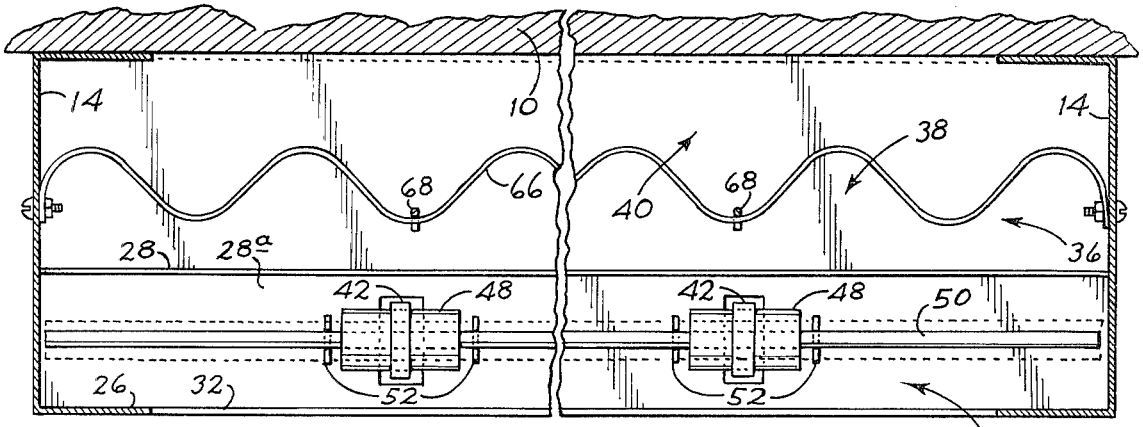
FIG. 2 is a foreshortened transverse sectional view taken along line 2—2 of FIG. 1.

The construction of the cooperating inner curtain assembly 36 is illustrated particularly in FIGS. 2 and 3.

In the embodiment illustrated, the curtain comprises a sheet 66, preferably a corrugated sheet of highly heat-conductive aluminum or other incombustible material. The application of the corrugated sheet is preferred because of its increased surface area, because it can be rolled up for packaging, and because of its increased rigidity and strength.

It will be noted from FIG. 3 that curtain 66 terminates at its upper end short of header 16 and at its lower end short of base 12. There thus is provided a passageway which is a continuation of cold air inlet 64 at the bottom of the curtain and another passageway which communicates with hot air vent 32 at the upper end of the curtain.

The illustrated means for hanging curtain 66 comprises a plurality of hooks 68 the upper bent ends of which are welded or otherwise affixed to the undersurface of top segment 24 of the header and the lower bent portions of which enter openings in the upper margin of curtain 66, provided for the purpose of hanging the curtain.

In the practice of my invention a number of alternatives suggest themselves. These are not illustrated, but are self evident from the foregoing discussion.

For example, whereas in the illustrated embodiment, the cold air inlet is provided at the lower end of the case, another embodiment of the invention might provide for the introduction of cold air from the sides, either into the front convection chamber 38, or into the rear chamber 40, or into both. In any case, if cold air is introduced from the sides, experience indicates that either one or both curtains should extend either close to or all the way to the base 12 in order to maximize the chimney effect within the panel.

A back wall of aluminum foil or other similar material might be placed over the combustible structural wall 10 to provide additional protection against the hazard of fire.

Instead of a single inner curtain assembly 36, there might be provided a plurality of parallel curtains spaced apart to isolate a volume of air between them.

A sheet of heat absorbent glass might be placed in front of the outer louvered curtain 34 to maximize the chimney effect of convected warm air in convection chambers 38, 40.

A mechanical blower might be provided to force air through the apparatus at an accelerated rate.

The space behind inner curtain 36 might be filled with fiberglass or other incombustible insulation.

A plurality of louvered curtains 34 might be used, and the louvers might be arranged in either vertical or horizontal configurations.

The inner curtain 66 might be coated with various special coatings, for example, a selective absorbing coating which absorbs radiant heat efficiently but which does not radiate heat well, thereby absorbing heat re-radiated from front curtain 34 and from structural wall 10.

Further variations within the spirit and scope of the invention will occur to persons skilled in the art.

OPERATION

Whatever the embodiment employed, the operation of the hereindescribed combination heat transfer panel and wall shield is as follows:

When mounted against a combustible structural wall 10 and screening the same from a stove or other closely juxtaposed radiant heater, the heat transfer panel receives radiant energy from the radiant heater through its front opening 20. If it is desired to reflect the heat back into the space from which it comes, louvers 44 are arranged with their convex reflective surfaces facing outwardly as shown in FIG. 3.

Figure 5:
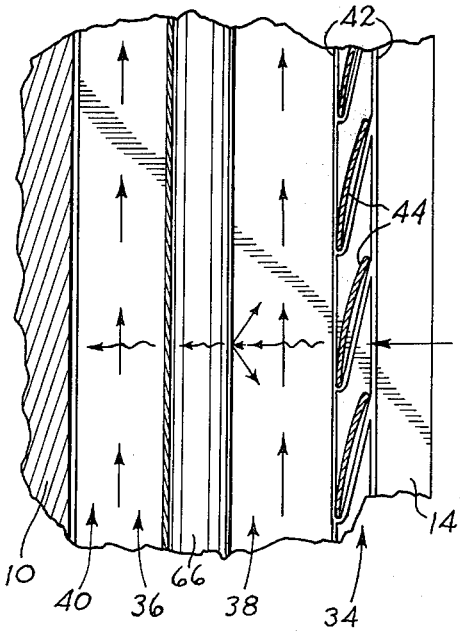

If, on the other hand, it is desired to absorb and transfer the radiant energy, the louvers are adjusted with their concave black heat absorbing surfaces facing outwardly as shown in FIG. 5. In this case the heat energy is absorbed and transferred to the first and second convection chambers 38 and 40, respectively, where a chimney effect is established. Cold air is drawn into the bottom of the unit through cold air inlet 64 and passes upwardly through convection chambers 38, 40. It exhausts from the unit through hot air vent 32.

Depending upon the intensity of the radiant heat source and upon the nature of the back wall 10, either of two treatments may be used with respect to inner curtain 66. The more radiant-energy-absorptive the curtain, the greater will be the amount of heat transferred to the air flowing along its surface. Higher, too, however, will be the temperature of the back wall 10. The more radiant-energy-reflective the curtain 66, the greater will be the amount of heat reflected away from itself and from the back wall 10. The result in this latter case will be a lower back wall temperature, but less heat transfer to the convected air. Different field conditions may require different treatments to realize fully both the benefits of heat transfer and of adequate wall protection.

Figure 4:
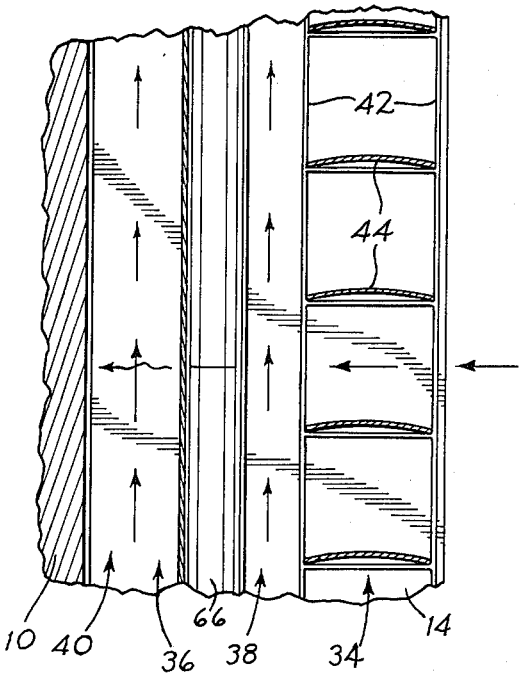
FIGS. 4 and 5 are fragmentary views similar to FIG. 3 but illustrate alternate operating positions of the panel.

If it is desired to decrease the chimney effect, louvers 44 may be opened to various angles. A minimum chimney effect in front convection chamber 38 will result from a wide open, that is horizontal, position such as is shown in FIG. 4.

If none of the above intensifying effects is required, the front of the panel may be constructed of a series of fixed louvers. Although less versatile than the system of movable louvers, the fixed louver system will by itself intensify the conduction of heat around the unit due to the irregular surfaces of the louvers and to the increased surface exposed, as compared to that provided by monolithic flat surfaces.

Inlet and exhaust air may be supplied and delivered in a variety of combinations through associated duct work or dampers, not illustrated, to suit the needs of the particular installation.

Thus cooler room air may be introduced, circulated through the convection chambers and returned to either the same room, to an adjacent or upstairs room, or out of doors. Cool outdoor air may be introduced and directed either back outdoors, into the heated room, or into an adjacent or upstairs room. Adjacent room air may be introduced and circulated in like manner.

In all of these applications, the unit standing closely adjacent the combustible structural wall 10 serves as a shield which prevents combustion of the wall. Accordingly, it is possible to place the stove or other radiant heater much closer to the wall than otherwise would be possible, thereby conserving a significant square footage of floor space which then may be put to a useful purpose.

Having thus described my invention in preferred embodiments, I claim as new and desire to protect by Letters Patent:

1. A combination heat transfer panel and wall shield for use between a stove type radiant heater and a combustible wall surface, comprising:

(a) a hollow case having a top wall and laterally spaced side walls, the case being arranged for support independently of and spaced from a radiant heater, (b) a front curtain comprising a plurality of spaced louvers mounted in the case adjacent the open front thereof and spanning the space between the lateral sides thereof, the front louver curtain terminating at its upper end below the top wall of the case and at its lower end above the bottom side of the case, (c) a rear curtain mounted in the case spaced rearwardly of the front louver curtain and forwardly of the rear side of the case and terminating at its upper end below the top wall of the case and at its lower end above the bottom side of the case, (d) the space between the front louver curtain and rear curtain defining a first vertical convection chamber and the space between the rear curtain and the rear side of the case defining a second vertical convection chamber, (e) the space between the bottom side of the case and the lower ends of the first and second curtains defining a cold air inlet communicating the bottom portion of the open front of the case with the bottom ends of the first and second vertical convection chambers, (f) the space between the top wall of the case and the upper ends of the first and second curtains defining a hot air outlet communicating the top portion of the open front of the case with the top ends of the first and second vertical convection chambers.

2. The combination heat transfer panel and wall shield of claim 1 including means for supporting the louvers of the front curtain for adjustment of one face of the louvers between forwardly and rearwardly facing positions.

3. The combination heat transfer panel and wall shield of claim 2 wherein one face of the louvers is reflective of radiant energy and the other face is absorptive of radiant energy.

* * * * *